US011686010B2

(12) United States Patent
Wang et al.

(10) Patent No.: US 11,686,010 B2
(45) Date of Patent: Jun. 27, 2023

(54) CARRIER LIQUID LEAKAGE PREVENTING DEVICE AND ELECTROCHEMICAL DEPOSITION APPARATUS

(71) Applicant: BOE Technology Group Co., Ltd., Beijing (CN)

(72) Inventors: Chengfei Wang, Beijing (CN); Junwei Yan, Beijing (CN); Guangcai Yuan, Beijing (CN); Shaodong Sun, Beijing (CN); Guocai Zhang, Beijing (CN); Shihao Dong, Beijing (CN); Pengcheng Dong, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/516,236

(22) Filed: Nov. 1, 2021

(65) Prior Publication Data

US 2022/0170174 A1 Jun. 2, 2022

(30) Foreign Application Priority Data

Nov. 30, 2020 (CN) ..... 202011380348.X

(51) Int. Cl.
*C25D 17/08* (2006.01)
*C25D 21/10* (2006.01)

(52) U.S. Cl.
CPC ..... *C25D 17/08* (2013.01); *C25D 21/10* (2013.01)

(58) Field of Classification Search
None
See application file for complete search history.

(56) References Cited

U.S. PATENT DOCUMENTS

2010/0006444 A1* 1/2010 Endo ..... C25D 17/001 204/666
2014/0295093 A1* 10/2014 Hirao ..... C23C 18/1632 204/198

FOREIGN PATENT DOCUMENTS

| | | | |
|---|---|---|---|
| CN | 107190305 | A | 9/2017 |
| CN | 109208062 | A | 1/2019 |
| CN | 111172581 | A | 5/2020 |
| CN | 211057250 | U | 7/2020 |
| CN | 211170943 | U | 8/2020 |
| EP | 0563022 | A1 | 9/1993 |

OTHER PUBLICATIONS

English translation JP 2019002065, Takahashi Jan. 10, 2019 (Year: 2019).*
CN 202011380348X first office action.

* cited by examiner

*Primary Examiner* — Stefanie S Wittenberg
(74) *Attorney, Agent, or Firm* — IPro, PLLC

(57) ABSTRACT

The present disclosure provides a carrier liquid leakage preventing device and an electrochemical deposition apparatus. The carrier liquid leakage preventing device is used for containing liquid medicine dripping from a carrier; the carrier liquid leakage preventing device comprises: a guide rail disposed along a first direction, the first direction is a vertical direction perpendicular to the horizontal plane or a direction at an angle to the horizontal plane; a leakage preventing groove provided on the guide rail and capable of performing a lifting movement along the guide rail so as to move above or below the carrier; and a driver for driving the lifting movement of the leakage preventing groove.

7 Claims, 6 Drawing Sheets

CARRIER LIQUID LEAKAGE PREVENTING DEVICE AND ELECTROCHEMICAL DEPOSITION APPARATUS

CROSS-REFERENCE TO RELATED APPLICATIONS

This application claims priority to Chinese Patent Application No. 202011380348.X filed in China on Nov. 30, 2020, the entire contents of which are hereby incorporated by reference.

TECHNICAL FIELD

The present disclosure relates to the technical field of electrochemical deposition, and more particularly, to a carrier liquid leakage preventing device and an electrochemical deposition apparatus.

BACKGROUND

In the related art, when an electrochemical deposition apparatus plates a thick copper on a substrate, the substrate is loaded onto a carrier, the carrier passes through a set process flow to perform process production in a designated process tank, and when a certain process tank is finished, a carrying mechanism (e. G. a travelling crane) carries the carrier from the process tank to the next process tank. When the carrier is removed from the process tank, the carrier may become saturated with chemicals in the tank, and a large amount of chemicals may drip during the process. The uncontrollable factors caused by the dripping of chemical agents affect the process yield of other process tanks and cause safety accidents due to corrosion of equipment.

SUMMARY

The technical solutions provided by the embodiments of the present disclosure are as follows:

Embodiments of the present disclosure provide a carrier liquid leakage preventing device for containing liquid medicine dripping from a carrier; the carrier liquid leakage preventing device comprises:

a guide rail disposed along a first direction, said first direction being a vertical direction perpendicular to the horizontal plane or a direction at an angle to the horizontal plane;

a leakage preventing groove provided on the guide rail and capable of performing a lifting movement along the guide rail so as to move above or below the carrier; and a driver for driving the lifting movement of the leakage preventing groove.

Optionally, the carrier comprises two opposite sides, and at least one of the two opposite sides is a bearing surface for bearing a substrate; and the leak preventing groove comprises at least a first part and a second part separated from each other by a predetermined distance so as to be respectively located on two opposite sides of the carrier; or, the first part and the second part are combined to form a channel structure with an opening facing upwards.

Optionally, the first part comprises a first baffle structure and the second part comprises a second baffle structure, and the first baffle structure and the second baffle structure each comprises a top end and a bottom end; and the first baffle structure and the second baffle structure are arranged in parallel and spaced apart; or the bottom ends of the first baffle structure and the second baffle structure are connected together to form a V-shaped groove structure.

Optionally, the first baffle structure is movably arranged on the guide rail, and the second baffle structure is connected to the first baffle structure via a link so that when the first baffle structure performs the lifting movement on the guide rail, the second baffle structure is lifted synchronously.

For example, a sliding block is provided on the guide rail, and the top end of the first baffle structure is connected to the sliding block via a first rotary shaft; and the second baffle structure is coupled to the link via a second rotary shaft.

Optionally, the bottom end of the first baffle structure is provided with a first magnetic component;

the bottom end of the second baffle structure is provided with a second magnetic component; and the first magnetic component and the second magnetic component cooperate with each other to interconnect or separate the bottom end of the first baffle structure and the bottom end of the second baffle structure.

Optionally, at least one of the first magnetic component and the second magnetic component is an electromagnetic component.

Optionally, the bottom ends of the first baffle structure and the second baffle structure are provided with sealing strips.

Optionally, the guide rail is a rack structure or a screw structure, and the driver comprises a servo motor.

An electrochemical deposition apparatus comprising: the carrier liquid leakage preventing device as described above.

DETAILED DESCRIPTION

Figure 1:
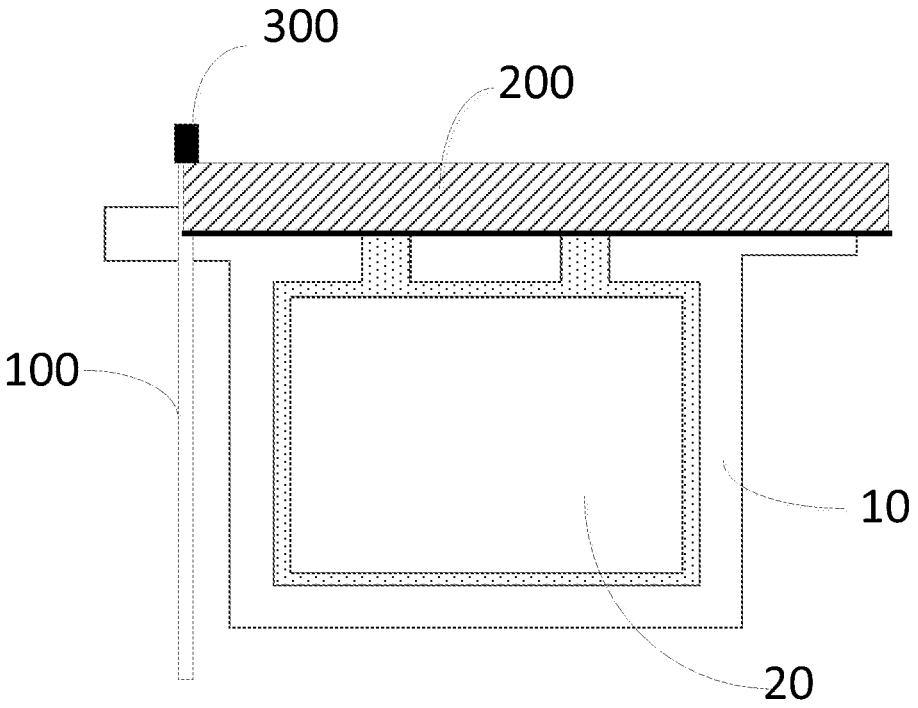
FIG. 1 shows a front view of the structure of a leakage preventing tray assembly in a first state of a carrier liquid leakage preventing device applied in an electrochemical apparatus according to some embodiments provided by the present disclosure.

In order that the objects, aspects and advantages of the embodiments of the present disclosure will become more apparent, a more particular description of the embodiments of the present disclosure will be rendered by reference to the appended drawings. It is to be understood that the described embodiments are part, but not all, of the disclosed embodiments. Based on the described embodiments of the present disclosure, all other embodiments that a person of ordinary skill in the art would obtain without inventive effort are within the scope of the present disclosure.

Unless defined otherwise, technical or scientific terms used in this disclosure shall have the ordinary meaning as understood by one of ordinary skill in the art to which this disclosure belongs. The use of "first", "second", and the like in this disclosure does not denote any order, quantity, or importance, but rather is used to distinguish one element from another. Likewise, terms such as "a", "an", or "the" do not denote a limitation of quantity, but rather denote the presence of at least one of the referenced item. The word "comprising" or "comprises", and the like, means that the presence of an element or item preceding the word covers the presence of the element or item listed after the word and equivalents thereof, but does not exclude other elements or items. "Connected" or "connected" and the like are not limited to physical or mechanical connections, but may include electrical connections, whether direct or indirect. The terms "upper", "lower", "left", "right" and the like are used only to indicate relative positional relationships that may change accordingly when the absolute position of the object being described changes.

Before describing in detail the carrier liquid leakage preventing device and the electrochemical deposition apparatus provided by the embodiments of the present disclosure, it is necessary to describe the related art as follows:

Among the related technologies, mini LED, as a new technology with broad market prospects, has the advantages of thin film, miniaturization and array, and will be gradually introduced into industrial applications. The application fields of Mini LED can be divided into two kinds of scenes: direct display and backlight. The Mini LED market size is expected to grow rapidly, thanks to the dual drive of the two big scenarios. In order to reduce power consumption and avoid overheating of the backlight caused by long lighting, it is necessary to reduce the impedance of the routing channel as much as possible. In the related art, in order to reduce the wiring resistance, which is usually achieved by thickening the conductive layer, there are mainly two schemes of magnetron sputtering and electrochemical deposition in terms of the current process. However, the thicker the magnetron sputtering film is, the larger the deformation of the glass substrate is, and it is easy to break in the process. Electrochemical deposition is a low-cost chemical film-forming method, which can deposit 2-20 um thick metal, so as to obtain a lower resistance. Electrodeposition has the advantages of high efficiency, low stress and low risk.

When the electrochemical deposition apparatus plates a thick copper on a substrate, the substrate is carried on a carrier, and the carrier passes through a set process flow to perform process production in a designated process tank 20; and when a certain process tank is finished, a carrying mechanism (for example, a travelling crane) carries the carrier from the process tank to the next process tank. When the carrier is removed from the process tank 20, the carrier may become saturated with chemicals in the tank, and a large amount of chemicals may drip during the process. The dropping of chemical agent causes uncontrollable factors, for example, the chemical agent drops to other tank bodies, affecting the solubility value of chemical agent in the tank body, affecting the uniformity of electrochemical deposition; chemical agent drips to other high-current carriers or mechanisms, corrodes internal electrical and mechanical parts of equipment, and is prone to electromechanical safety accidents; these acidic corrosive gases gradually corrode the upstream and downstream equipment as more chemicals drip into the equipment to accelerate volatilization.

Therefore, in order to solve the above-mentioned problems, embodiments of the present disclosure provide a carrier liquid leakage preventing device and an electrochemical deposition apparatus capable of preventing a chemical agent from dripping when the carrier is transferred between process tanks, thereby preventing the uniformity of the electrochemical deposition from being affected and preventing the device from corroding due to the dripping of the chemical agent.

Embodiments of the present disclosure provide a carrier leak prevention device for containing a liquid medicine dripping from a carrier, the carrier leak prevention device comprising:

a guide rail 100 arranged in a first direction, the first direction is a vertical direction perpendicular to the horizontal plane or a direction at an angle to the horizontal plane;

a leakage preventing groove 200 provided on the guide rail 100 and capable of performing a lifting movement along the guide rail 100 to move above or below the carrier 10; and a driver 300 for driving the lifting movement of the leakage preventing groove 200.

A liquid leakage preventing device and an electrochemical deposition apparatus for a carrier 10 in an embodiment of the present disclosure are provided with a leakproof groove 200 capable of being lifted and lowered on a guide rail 100; when the carrier 10 performs process production inside a process groove, the leakproof groove 200 can be moved above the carrier 10; when the carrier 10 is lifted out of the current process groove after the process in the current process groove is completed, the leakproof groove 200 can be moved to the bottom of the carrier 10, so that a chemical agent is collected in the leakproof groove 200 during the carrying process of the carrier 10 and reaches the next process groove; raising above the carrier 10 avoids dripping of the chemical as the carrier 10 is transferred between the process tanks, thereby avoiding affecting the uniformity of the electrochemical deposition and avoiding equipment corrosion due to dripping of the chemical.

It is noted that the first direction may be a vertical direction perpendicular to the horizontal plane, or may be a direction at an angle to the horizontal plane, e. G. Within 0-30 deg.

In the above-mentioned solution, the structure of the leakproof groove 200 can be various, as long as it has a groove structure capable of receiving the liquid medicine dripping from the carrier 10; in view of the limited equipment space in the electrochemical deposition equipment, it is necessary to have enough space for the leakproof groove 200 to move from above the carrier 10 to the bottom of the carrier 10 when the carrier 10 moves out of the process groove; and if the leakproof groove 200 is designed as an integral groove structure, the reserved movable space of the leakproof groove 200 is large, that is to say, the space occupied by the structure of the liquid leakproof device of the whole carrier 10 is large.

In order to reduce the structural space of the liquid leakage preventing device of the entire carrier 10, the present disclosure provides an exemplary embodiment in which the carrier 10 comprises two opposite sides, at least one of which is a bearing surface for bearing a substrate;

the leak prevention groove 200 includes at least a first part and a second part having a first state and a second state therebetween.

In the first state, the first part and the second part are in a separated state and are spaced apart by a predetermined distance so as to be respectively located on opposite sides of the carrier 10;

In the second state, the first part and the second part combine to form a channel structure with the opening facing upward.

In the above-mentioned solution, the leakage preventing groove 200 is designed as a split structure, comprising at least a first part and a second part, such that when the carrier 10 performs process production inside a process groove body, the leakage preventing groove 200 is located above the carrier 10, and at this time, the first part and the second part are in a separated state, and are respectively located at two opposite sides of the carrier 10; after the process in the current process tank is completed, during the lifting process of the carrier 10, the first part and the second part of the leakproof groove 200 can be moved down to the bottom of the carrier 10, and the first part and the second part on both sides are combined to form a groove structure with an upward opening; at this time, the chemical agent is collected in the groove structure during the carrying process of the carrier 10, and after reaching the next process tank, the first part and the second part of the leakproof groove 200 are automatically opened to be separated and lifted above the carrier 10. With such a structure, it is possible to effectively reduce the moving space of the leak preventing groove 200 and simplify the structure.

In some exemplary embodiments, as shown, the first part includes a first baffle structure 210 and the second part includes a second baffle structure 220, both the first baffle structure 210 and the second baffle structure 220 including a top end and a bottom end; in the first state, the first baffle structure 210 and the second baffle structure 220 are arranged in parallel and spaced apart; in the second state, at least one of the first baffle structure 210 and the second baffle structure 220 is rotated so that the bottom ends of the first baffle structure 210 and the second baffle structure 220 are connected together to form a V-shaped channel structure.

With the above-mentioned solution, the first part and the second part are both baffle structures, and the two baffle structures can be in a parallel state when being located above the carrier 10, and when the carrier 10 is removed from the process tank, the two baffle structures can be lowered in parallel, and when reaching the bottom of the carrier 10, the bottom ends of the two baffle structures are connected together to form a V-shaped groove structure.

It should be noted that the specific structure of the first part and the second part may not be limited, and only one of the first baffle structure 210 and the second baffle structure 220 may be rotated, or both may be rotated so that the bottom ends of the two baffle structures are connected together.

Further, in some exemplary embodiments, the first baffle structure 210 is movably disposed on the guide rail 100, and the second baffle structure 220 is connected to the first baffle structure 210 by a link 240 such that the second baffle structure 220 is synchronously raised and lowered when the first baffle structure 210 is raised and lowered on the guide rail 100.

With the above-mentioned solution, the first baffle structure 210 and the second baffle structure 220 are linked via a connecting rod 240 so as to achieve synchronous lifting, and thus only one guide rail 100 and drive mechanism 300 can be provided in the first baffle structure 210 and the second baffle structure 220. It will of course be understood that, in practice, it is also possible that the guide rail 100 and the drive mechanism 300 are provided with two sets, corresponding to the first baffle structure 210 and the second baffle structure 220, respectively.

Furthermore, in some exemplary embodiments, a slide is provided on the guide rail 100, and a top end of the first baffle structure 210 is connected to the slide via a first rotation axis; the second baffle structure 220 is connected to the link 240 by a second rotation shaft.

With the above-mentioned solution, the first baffle structure 210 is connected to the sliding block via a first rotary shaft, and this movable connection mode enables the first baffle structure 210 to perform a lifting movement and a rotary movement on the guide rail 100; likewise, the second baffle structure 220 is connected to the connecting rod 240 via a second rotary shaft, so as to achieve the lifting and rotary movement of the second baffle structure 220. It will be understood, of course, that the manner of connection between the first baffle structure 210 and the second baffle structure 220 and the guide rail 100 is not limited in practice.

Furthermore, in some exemplary embodiments of the present disclosure, as shown in FIGS. 1-6, the bottom end of the first baffle structure 210 is provided with a first magnetic component 211; the bottom end of the second baffle structure 220 is provided with a second magnetic component 221, and the first magnetic component 211 and the second magnetic component 221 cooperate with each other to interconnect or separate the bottom end of the first baffle structure 210 and the bottom end of the second baffle structure 220.

Optionally, at least one of the first magnetic component 211 and the second magnetic component 221 is an electromagnetic component.

With the above-mentioned solution, by respectively providing a first magnetic component 211 and a second magnetic portion at the bottom ends of the first baffle structure 210 and the second baffle structure 220, at least one of the first magnetic component 211 and the second magnetic component 221 is an electromagnetic component, and the other can be a permanent magnet or an electromagnetic component, so that the purpose of separating the first baffle structure 210 and the second baffle structure 220 in a first state and connecting the bottom ends in a second state can be controlled by controlling a current signal on the electromagnetic component.

It should be noted that, in practical applications, the manner in which the first baffle structure 210 and the second baffle structure 220 are controlled to be separated in the first state and connected at the bottom end in the second state is not limited to this, and for example, a guide structure, such as a guide slope or the like, may be provided at the bottom end of the guide rail 100, and when the first baffle structure 210 and the second baffle structure 220 move to the bottom end of the guide rail 100, rotary inclination occurs guided by the guide structure, forming a V-shaped groove structure.

Further, in some exemplary embodiments, the bottom ends of the first 210 and second 220 baffle structures are provided with sealing strips 230.

Figure 2:
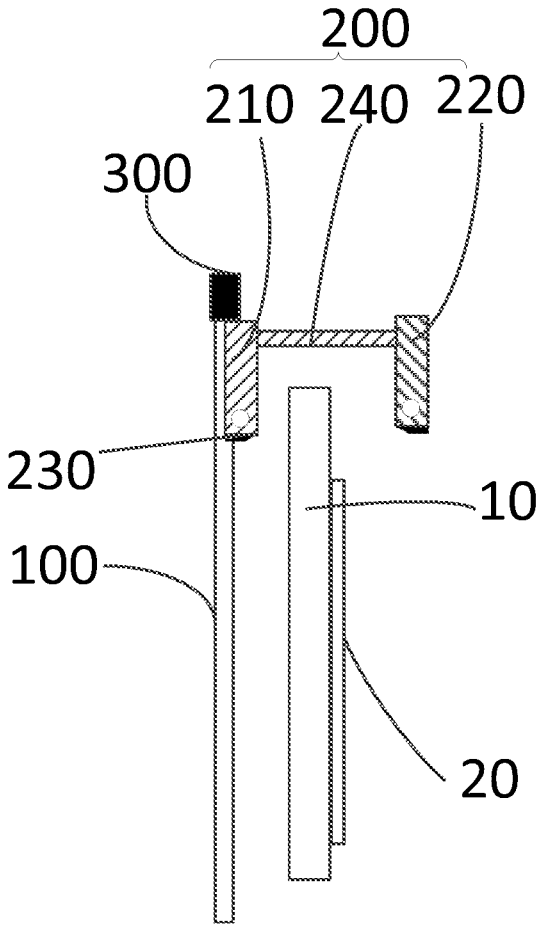
FIG. 2 shows a side view of the structure of a leakage preventing tray assembly in the first state of a carrier liquid leakage preventing device applied in an electrochemical apparatus according to some embodiments provided by the present disclosure.
Figure 3:
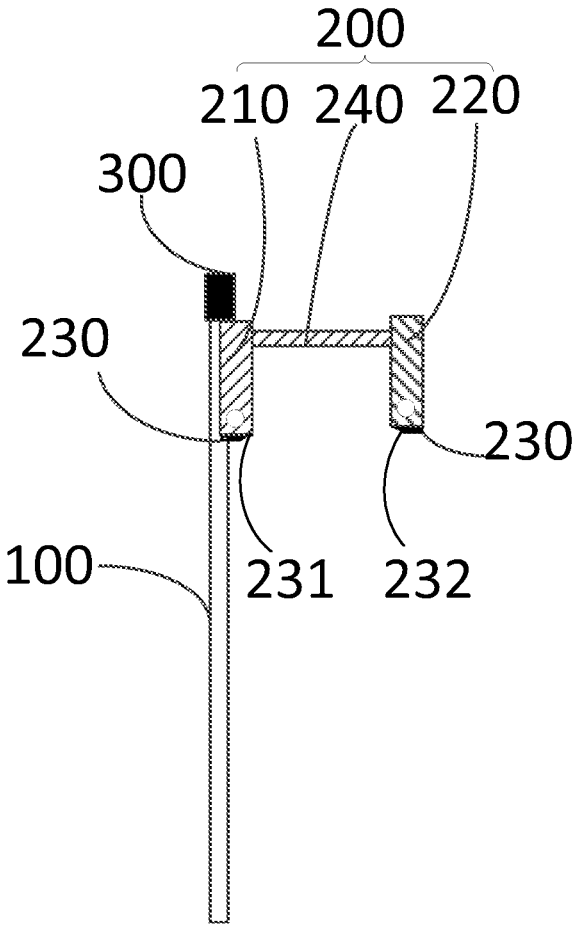
FIG. 3 shows a side view of the structure of a leakage preventing tray assembly in the first state of a carrier liquid leakage preventing device according to some embodiments provided by the present disclosure.
Figure 4:
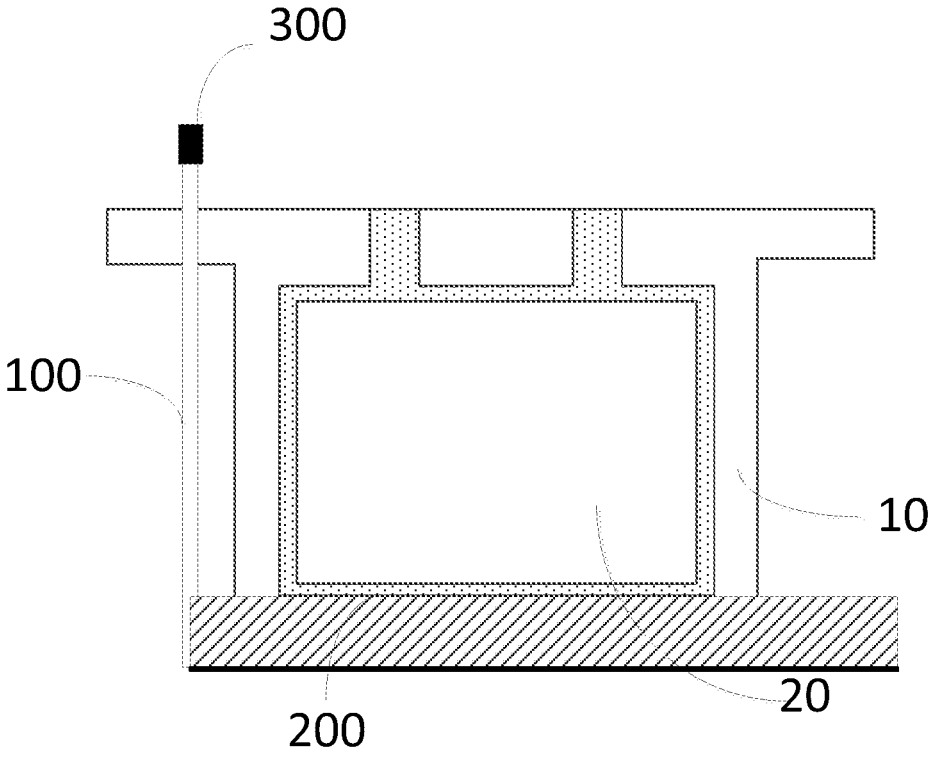
FIG. 4 shows a front view of the structure of a leakage preventing tray assembly in a second state of a carrier liquid leakage preventing device in some embodiments provided by the present disclosure.
Figure 5:
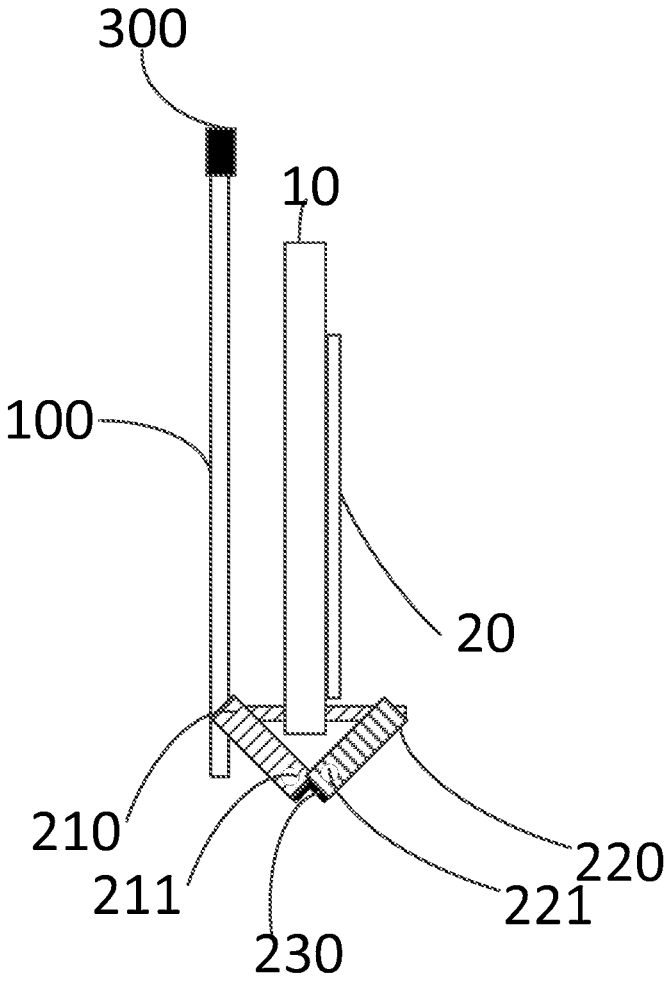
FIG. 5 shows a side view of the structure of a leakage preventing tray assembly in the second state of a carrier liquid leakage preventing device according to some embodiments provided by the present disclosure.
Figure 6:
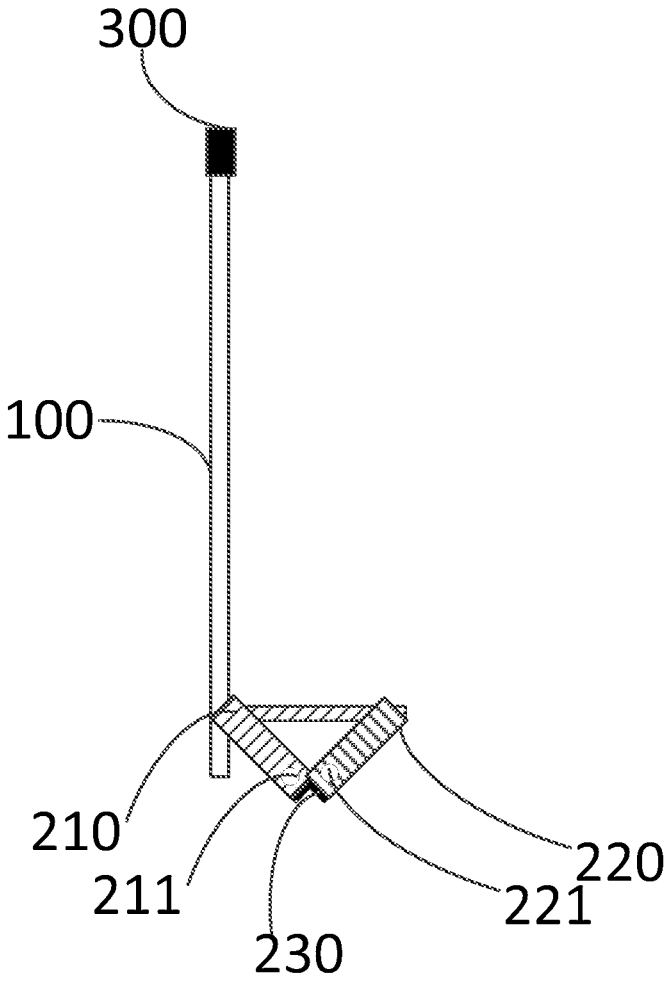
FIG. 6 shows a side view of the structure of a leakage preventing tray assembly in the first state of a carrier liquid leakage preventing device according to some embodiments provided by the present disclosure.

As an example, the sealing strip 230 may be a sealing strip having a cut angle. As shown in FIGS. 2 and 6, since the bottom ends of the first baffle structure 210 and the second baffle structure 220 are connected together to form a V-shaped groove structure in the second state, the first baffle structure 210 and the second baffle structure 220 have a certain included angle therebetween, and then the sealing strip located at the bottom end of the first baffle structure 210 and the sealing strip located at the bottom end of the second baffle structure 220 are closely contacted and abutted to ensure liquid-tight sealing. And the sealing strip has a cut angle, that is to say, one end of the sealing strip at the bottom end of the first baffle structure 210 close to the second baffle structure 220 has a first chamfered surface 231, and one end of the sealing strip at the bottom end of the second baffle structure 220 close to the first baffle structure 210 has a second chamfered surface 232, wherein the first chamfered surface 231 and the second chamfered surface 232 can achieve close contact fitting so as to ensure sealing.

It should also be noted that the tangential angle of the sealing strip on the first baffle structure 210 coincides with the angle of inclination of the first baffle structure 210, and the tangential angle of the sealing strip on the second baffle structure 220 coincides with the angle of inclination of the second baffle structure 220. For example, if the first baffle structure 210 and the second baffle structure 220 inclined in opposite directions with respect to a horizontal plane at an angle of 45 deg. and then the sealing strips on the first baffle structure 210 and the second baffle structure 220 are also inclined at an angle of 45 deg.

Further, in some exemplary embodiments, the guide rail 100 is a rack structure or a lead screw structure, and the drive mechanism 300 includes a servo motor.

With the above-mentioned scheme, the PLC (Programmed Controller) directly sends pulse commands through the servo motor control to precisely and quickly control the operation of the leak-proof plate assembly to the designated position.

The guide rail 100 can be made of a corrosion-resistant material, and can safely and smoothly drive the leakage preventing groove 200 to move up and down.

It is understood that the specific structures of the guide rail 100 and the driver 300 are not limited thereto.

The leak-proof device of the carrier 10 provided by the embodiments of the present disclosure is applicable to the fields of electrochemical deposition of metals such as Ni, Ag, etc. and applicable to the large-scale wet-type equipment.

The liquid leakage prevention device for a carrier according to the embodiments of the present disclosure is capable of preventing a chemical agent from dripping when the carrier is transferred between process tanks, thereby preventing the uniformity of electrochemical deposition from being affected and preventing an device corrosion problem caused by the dripping of the chemical agent.

In addition, embodiments of the present disclosure also provide an electrochemical deposition apparatus comprising: embodiments of the present disclosure provide a vehicle 10 leakproof device.

Advantageous effects brought about by embodiments of the present disclosure are as follows:

A carrier liquid leakage preventing device and an electrochemical deposition apparatus of an embodiment of the present disclosure are provided with a leakproof groove capable of being lifted and lowered on a guide rail; when a carrier performs process production inside a process groove, the leakproof groove can be moved above the carrier; and when the carrier is lifted out of the current process groove after the process in the current process groove is completed, the leakproof groove can be moved to the bottom of the carrier, so that a chemical agent is collected in the leakproof groove during the carrying process of the carrier, and is lifted above the carrier after reaching the next process groove, such that It is possible to avoid dripping of the chemical agent when the carrier is transferred between process tanks, thereby avoiding affecting the uniformity of the electrochemical deposition and avoiding equipment corrosion caused by dripping of the chemical agent.

The following points need to be explained:

(1) The drawings relate only to the structures to which the embodiments of the present disclosure relate, and other structures may refer to general designs.

(2) In the drawings used to describe embodiments of the present disclosure, the thickness of layers or regions is exaggerated or reduced for clarity, i. E. the drawings are not to scale. It will be understood that when an element such as a layer, film, region or substrate is referred to as being "on" or "under" another element, it can be "directly on" or "directly under" the other element or intervening elements may be present.

(3) Without conflict, embodiments of the present disclosure and features of the embodiments may be combined with each other to provide new embodiments.

While the foregoing is directed to embodiments of the present disclosure, other and further embodiments of the disclosure may be devised without departing from the basic scope thereof, and the scope thereof is determined by the claims that follow.

What is claimed is:

1. A carrier liquid leakage preventing device for containing liquid dripping from a carrier; wherein the carrier liquid leakage preventing device comprises:

a guide rail disposed along a first direction, said first direction being a vertical direction perpendicular to the horizontal plane or a direction at an angle to the horizontal plane;

a leakage preventing groove provided on the guide rail and capable of performing a lifting movement along the guide rail so as to move above or below the carrier; and a driver for driving the lifting movement of the leakage preventing groove, wherein the carrier comprises two opposite sides, and at least one of the two opposite sides is a bearing surface for bearing a substrate; and the leak preventing groove comprises at least a first part and a second part separated from each other by a predetermined distance so as to be respectively located on two opposite sides of the carrier; or, the first part and the second part are combined to form a channel structure with an opening facing upwards, the first part comprises a first baffle structure and the second part comprises a second baffle structure, and the first baffle structure and the second baffle structure each comprises a top end and a bottom end; and the first baffle structure and the second baffle structure are arranged in parallel and spaced apart, or the bottom ends of the first baffle structure and the second baffle structure are connected together to form a V-shaped groove structure;

wherein the bottom end of the first baffle structure is provided with a first magnetic component; the bottom end of the second baffle structure is provided with a second magnetic component; and the first magnetic component and the second magnetic component cooperate with each other to interconnect or separate the bottom end of the first baffle structure and the bottom end of the second baffle structure.

2. The carrier leak prevention device according to claim 1, wherein the first baffle structure is movably arranged on the guide rail, and the second baffle structure is connected to the first baffle structure via a link so that when the first baffle structure performs the lifting movement on the guide rail, the second baffle structure is lifted synchronously.

3. The carrier leak prevention device according to claim 2, wherein a sliding block is provided on the guide rail, and the top end of the first baffle structure is connected to the sliding block via a first rotary shaft; and the second baffle structure is coupled to the link via a second rotary shaft.

4. The carrier leak prevention device according to claim 1, wherein at least one of the first magnetic component and the second magnetic component is an electromagnetic component.

5. The carrier leak prevention device according to claim 1, wherein the bottom ends of the first baffle structure and the second baffle structure are provided with sealing strips.

6. The carrier leak prevention device according to claim 1, wherein:

the guide rail is a rack structure or a screw structure, and the driver comprises a servo motor.

7. An electrochemical deposition apparatus comprising: a carrier liquid leakage preventing device according to claim 1.

* * * * *